US006319560B1

(12) United States Patent
Hawley et al.

(10) Patent No.: US 6,319,560 B1
(45) Date of Patent: Nov. 20, 2001

(54) APPARATUS AND METHOD FOR COATING THE OUTER SURFACE OF A WORKPIECE

(75) Inventors: David Hawley, Kings Park; Montia Nestler, Farmingdale; Kevin Varley, Smithtown, all of NY (US)

(73) Assignee: Sulzer Metco (US) Inc., Westbury, NY (US)

( * ) Notice: Subject to any disclaimer, the term of this patent is extended or adjusted under 35 U.S.C. 154(b) by 0 days.

(21) Appl. No.: 09/538,074

(22) Filed: Mar. 29, 2000

(51) Int. Cl.[7] ..... C23C 4/12; B05B 3/12

(52) U.S. Cl. ..... 427/446; 427/422; 118/302; 118/323; 239/79; 239/85

(58) Field of Search ..... 427/446, 422; 118/302, 323; 239/79, 85; 219/76.14, 76.16

(56) References Cited

U.S. PATENT DOCUMENTS 4,358,471 * 11/1982 Derkacs et al. ..... 427/422

FOREIGN PATENT DOCUMENTS 33 01 548 A1 * 7/1984 (DE) .

* cited by examiner

*Primary Examiner*—Katherine A. Bareford
(74) *Attorney, Agent, or Firm*—Ira J. Schaefer, Esq.; Clifford Chance Rogers & Wells LLP

(57) ABSTRACT

A method and apparatus for coating the outer surface of a workpiece comprises disposing a workpiece in a fixed position along an axis and rotating a thermal spray gun around the axis on a support with a thermal spray thereof directed towards the axis. The powder, fuel and oxygen are rotatably coupling to the gun and the thermal spray gun and the support are moving along the axis while rotating.

16 Claims, 3 Drawing Sheets

APPARATUS AND METHOD FOR COATING THE OUTER SURFACE OF A WORKPIECE

BACKGROUND OF THE INVENTION

The present invention relates to a method and apparatus for coating the outer surface of a workpiece.

Thermal spraying, also known as flame spraying, involves the heat softening of a heat fusible material, such as a metal or ceramic, and propelling the softened material in particulate form against the surface which is to be coated. In many instances where a three dimensional object is to be coated, the thermal spray gun is held in a fixed position and the object is moved relative to the gun in order to coat the entire outer surface.

The ability to move the workpiece while the gun is stationary is possible in many situations, however, it is impractical where the workpiece is large in size or where it is desired to recoat a workpiece while it is still mounted in place, for example, the landing gears for an aircraft. The difficulty of moving the landing gears of an aircraft while connected to the aircraft is evident.

There is therefore a need for an apparatus and method for coating the outer surface of a workpiece while the workpiece is held stationary.

SUMMARY OF THE INVENTION

The main object of the present invention is to provide an apparatus and method for coating the outer surface of a workpiece wherein a thermal spray gun is rotated around a workpiece disposed at the axis of rotation of the thermal spray gun.

Another object of the present invention is to provide a convenient and simple method and apparatus for supplying the oxygen, fuel and powder to the thermal spray gun while it is rotating.

These and other objects of the present invention are achieved in accordance with the present invention by an apparatus having a support mounted for rotation about an axis and having a fixture mounting a thermal spray gun with a coating spray thereof directed towards the axis, whereby a workpiece disposed at the axis will be coated thereby. The thermal spray gun has inputs for powder, fuel and oxygen and a supply line for each of the powder, fuel and oxygen is rotatable with the support for supplying the powder, fuel and oxygen to the thermal spray gun. At least one coupling having a first portion rotatable with the support and a second portion having ports for receiving the powder, fuel and oxygen communicates the powder, fuel and oxygen to the corresponding supply lines. A motor rotates the support.

In order to coat the outer surface of a workpiece, such as a landing gear which is of substantial length, the apparatus further comprises a mechanism for moving the support, supply lines, coupling and motor parallel to the axis to effect a coating of an outer surface along a length of the workpiece.

In accordance with the invention, in a particularly advantageous commercial embodiment of the invention, the thermal spray gun is a high velocity oxy fuel spray gun. Such a gun is disclosed in U.S. Pat. No. 4,865,252, the disclosure of which is incorporated herein by reference.

In accordance with the method of the present invention, a workpiece is disposed in a fixed position along an axis and a thermal spray gun is rotated around the axis on a support with the thermal spray thereof directed towards the axis. Powder, fuel and oxygen are rotatably coupled to the gun and the thermal spray gun and the support are moved along the axis while rotating.

Another object of the present invention is to provide an apparatus and a method for the rotation of a thermal spray gun with powder injection for the purpose of applying a coating on to a stationary part outer diameter.

In accordance with the present invention, a rotary coupling with five channels, including water in, water out, fuel gas, oxygen and air cooling and with an additional center feed-through for powder flow, has a center shaft rotating within a stationary housing. The shaft assembly is driven via a belt drive by an electric motor to create a constant speed rotation. A manifold block attaches to the center shaft to provide a convenient hose connection point. The process gun is fixtured to the device in an arrangement that causes the gun to be aimed towards the center of rotation. The fixturing scheme allows the adjustment of the gun distance from the center line to optimize the spray distance based on a part diameter.

A counterbalance is fixtured opposite the gun for dynamic balance while rotating. Powder is delivered through the center of the rotating shaft and a separate stainless steel tube is attached to the manifold connection block. The tube rotates with the device and extends beyond the rotary coupling. The rotary powder feedthrough consists of a two part stationary housing. An O-ring provides a positive gas tight seal and a set of compressed felt packings protect the O-ring from abrasive powders. A port is provided to create a positive gas flow through the felt packings. The end cap includes the hose connection and provides compression and retention for the felt packing.

In accordance with the method of the present invention, the device is mounted onto a robot or other device that provides a linear motion along the center of rotation. The device is positioned above the workpiece, for example a shaft, to be coated and the gun is lit. The device is then rotated with the gun lit and powder is introduced and the entire rotating device is advanced slowly over the shaft creating a desired coating.

The present invention allows for the thermal spray coating of outer diameters that cannot practicably be rotated. The apparatus and method eliminate the requirement for large complex part handling equipment and related room and exhaust.

These and other features and advantages of the present invention will be disclosed hereinafter in more detail with reference to the attached drawings, wherein,

DETAILED DESCRIPTION OF THE INVENTION

Figure 1:
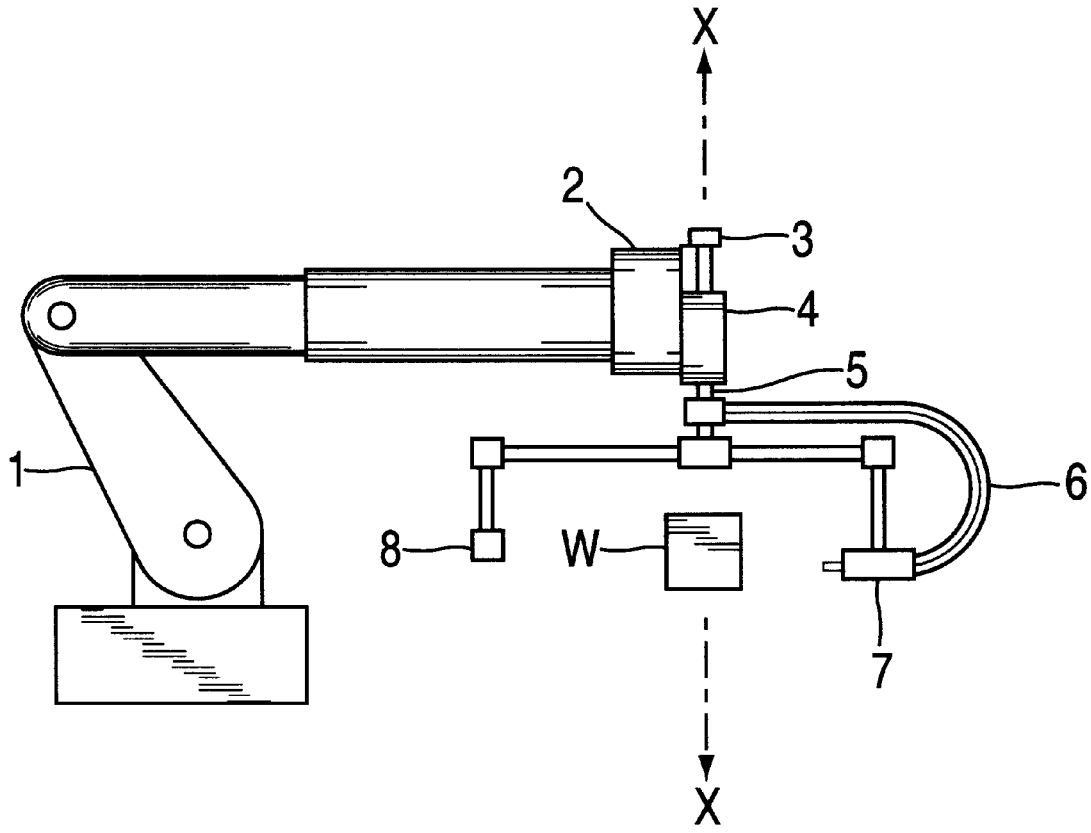
FIG. 1 is a diagram of the apparatus according to the present invention for carrying out the method according to the present invention.

Referring now to FIG. 1, the apparatus according to the present invention for coating a workpiece W comprises a support 5 which supports a thermal spray gun 7 and a counterbalance 8 which is mounted for rotation on a shaft about an axis of rotation x. The support 5 is rotated by motor 2 to rotate about the axis of rotation x. Supplies for the thermal spray gun, as well as cooling air and water, are provided through rotary couplings 3 and 4 and supply lines 6. A robot 1 is operatively connected to the elements 2–8 to move those elements linearly along axis x to effect a coating of the entire desired length of the workpiece W.

Figure 2:
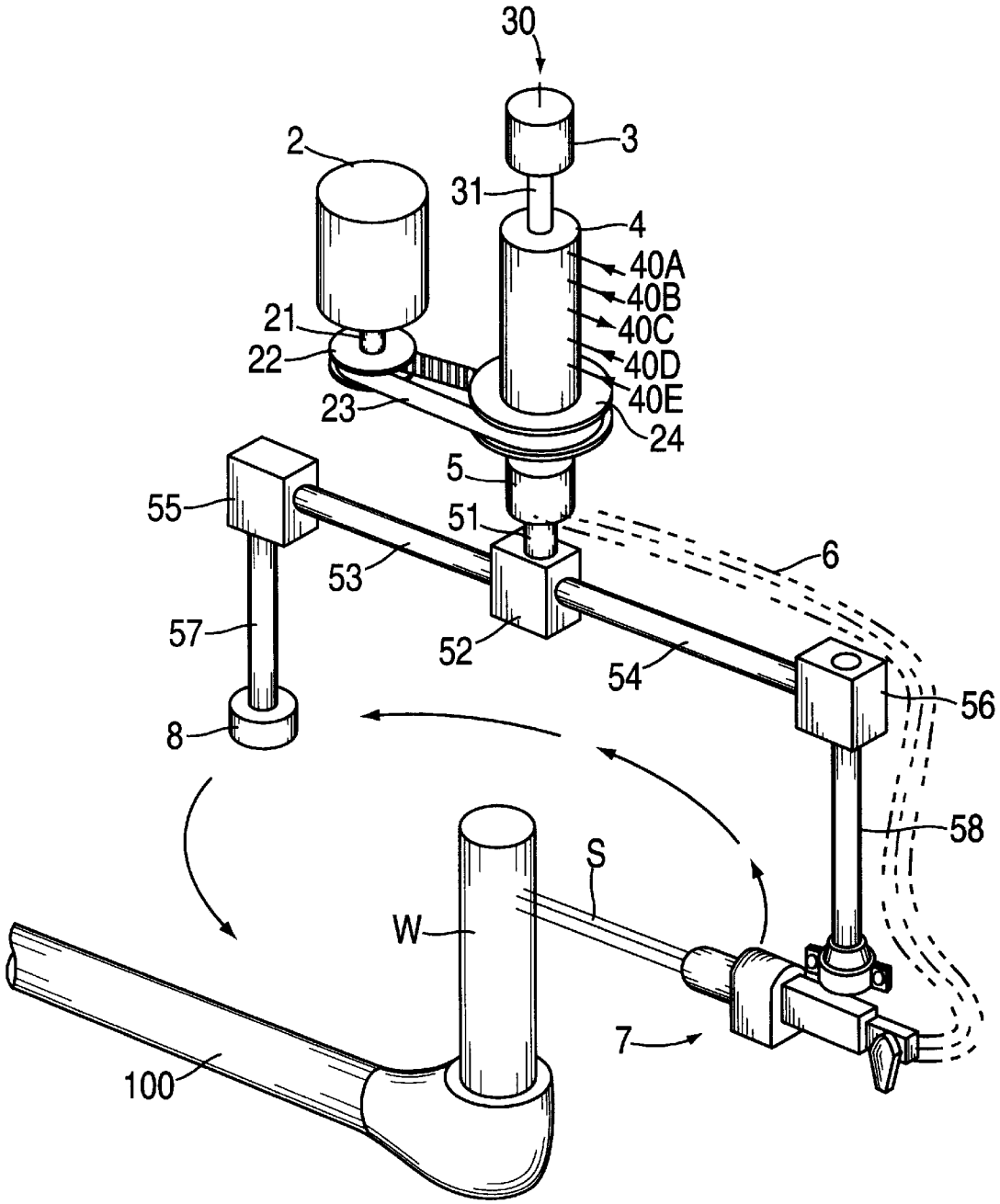
FIG. 2 is a detailed perspective view of part of the apparatus shown in FIG. 1.

Referring now to FIG. 2, the apparatus elements 2–8 of FIG. 1 are shown in more detail.

The motor 2 has a shaft 21 to which a pulley 22 is rotably connected for driving a belt 23 which is connected to pulley 24 and which is connected to support 5 to rotate same relative to the stationary housing portion of the rotary coupling 4.

The rotary powder coupling 3 has a powder input 30 and a connecting line 31 to the rotary coupling 4 which has 5 channel inputs and outputs 40A–40E as will be explained. Channel 40A is an input for water, channel 40B is an input for hydrogen fuel gas input, channel 40C is a water outlet channel, channel 40D is an oxygen input channel and channel 40E is an input for cooling air.

The support 5 includes a manifold connection block 51 which connects to a tubular support block 52 having tubular members 53 and 54 connected in holes therein and having further tubular support blocks 55 and 56 connected thereto and having tubular fixture members 57 and 58 depending downwardly therefrom.

Tubular fixture number 58 is connected to the thermal spray gun 7 and tubular fixture number 57 has counterbalance 8 connected thereto. The counterbalance dynamically balances the gun while rotating.

Powder is fed via the tubular numbers 54 and 58 to the thermal spray gun, while lines 6 carry water in, hydrogen fuel gas in, oxygen in and cooling air in and carry water out.

Workpiece W is held in place by a fixture 100 at the center of rotation of holder 5 so that the thermal spray gun rotates around the workpiece W spraying the spray S at the outer surface thereof.

Figure 3:
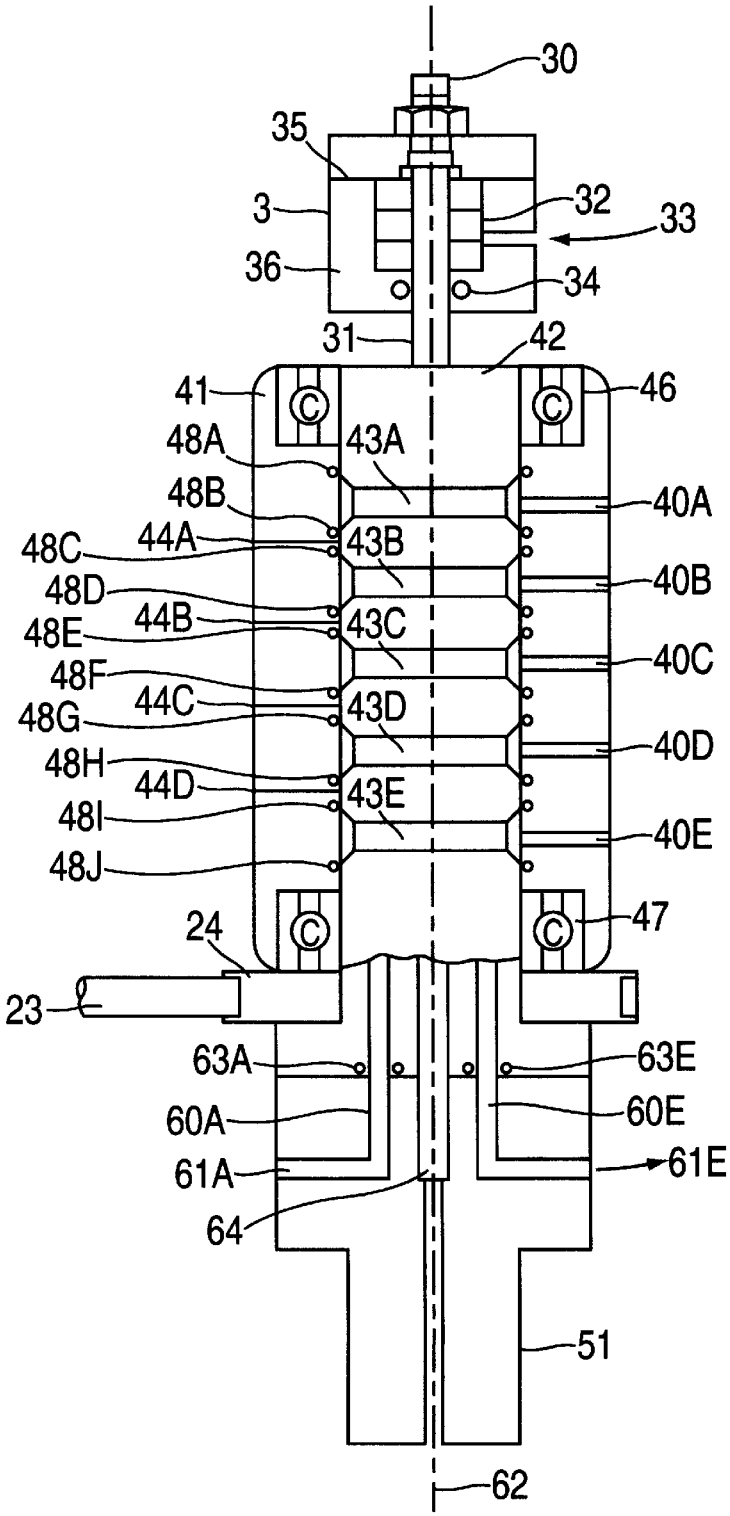
FIG. 3 is a detailed sectional view of the couplings of FIG. 2.

FIG. 3 shows the rotary couplings 3 and 4 in more detail.

The rotary powder coupling 3 has the powder fitting 30 which feeds powder line 31 which rotates within a housing having an upper portion 35 and a lower portion 36 with felt packing 32 therein around the powder line and sealed with an O-ring seal 34. The coupling also has a seal pressure port 33. The tube 31 rotates with the device and powder is fed therethrough. The O-ring 34 provides a positive gastight seal and the set of the compressed felt packings protect the O-ring from abrasive powders. Post 33 is provided to create a positive gas flow through the felt packing and the end cap includes a hose connection and provides compression and retention for the felt packing.

The rotary coupling 4 has a stationary outer housing 41 and a rotatable inner member 42, which is rotatable by means of bearings 46 and 47 at either end of the housing 41. The rotatable member 42 has grooves 43A–43E which are mounted in alignment with connection ports 40A–40E respectively and which are sealed from each other by means of O-rings 40A–40J.

Each of the grooved areas 43A–43E are in communication with channels 60A–60E respectively, of which only channels 60A and 60E are shown. Channels 60A–60E are in communication with connection ports 61A–61E which are in turn connected to lines 6. Powder outlet 62 feeds through block 52 and tubular elements 54 and 58 to feed powder to the gun 7. The rotatable member 42 is connected to the block 51 for rotation therewith using O-rings 63A–63E to maintain a seal along the channels 60A–60E.

The housing 41 has weep ports 40A–40D and the tube 31 is connected in the member 42 to stainless steel tube 64. The tube 64 is connected to manifold connection block 51.

In operation, the device is mounted onto the robot to provide a linear motion along the center of rotation. The device is positioned above the shaft to be coated and the gun is lit. Device is then rotated with the gun lit and powder is introduced and the entire rotating device is advanced slowly over the shaft creating a desired coating.

The rotating coupling with the five channels and the additional center feed through for powder supplies the necessary fuels to the gun and provides for a water output. The center shaft rotates within the stationary housing and the shaft assembly is driven via the belt drive to create a constant speed rotation. The manifold block attaches to the center shaft to provide a convenient hose connection point. The process gun is fixtured to the device so that the gun is aimed towards the center of rotation and the fixturing allows the adjustment of the gun distance from the center line to optimize the spray distance based on the part diameter.

What is claimed is:

1. A method for coating the outer surface of a workpiece, comprising the steps of:

disposing a workpiece in a fixed position along an axis;

rotating a thermal spray gun around the axis on a member downwardly depending from a support with a thermal spray thereof directed towards the axis to space the thermal spray gun from the support along the axis;

rotatably coupling powder, fuel and oxygen to the gun; and moving the thermal spray gun and the support along the axis independently of the surface of the workpiece to be coated to move the thermal spray gun along the entire length of the workpiece along the axis while rotating.

2. The method according to claim 1, wherein the thermal spray gun is a high velocity oxy-fuel spray gun.

3. The method according to claim 1, wherein the gun is a powder combustion gun.

4. The method according to claim 1, wherein the powder is supplied to the gun through the support.

5. The method according to claim 1, further comprising counterbalancing the gun to dynamically balance the gun during rotation.

6. The method according to claim 1, wherein the step of rotatably coupling comprises coupling with two couplings including a first coupling for the powder and a second coupling for the fuel and oxygen.

7. The method according to claim 6, wherein the second coupling has ports receptive of cooling air and has an inlet and an outlet for water and further comprising supply lines for the air and water.

8. The method according to claim 1, further comprising adjusting a radial distance between the thermal spray gun and the workpiece.

9. An apparatus for coating the outer surface of a workpiece, comprising:

a support mounted for rotation about an axis and having a fixture mounting a thermal spray gun with a coating spray thereof directed towards the axis, wherein the fixture includes a downwardly depending member to which the thermal spray gun is connected and which spaces the thermal spray gun from the support along the axis to permit a workpiece to be coated along its entire length parallel to the axis and whereby the workpiece disposed at the axis will be coated thereby;

wherein the thermal spray gun has inputs for powder, fuel and oxygen;

a supply line for each of the powder, fuel and oxygen rotatable with the support for supplying the powder, fuel and oxygen to the thermal spray gun;

at least one coupling having a first portion rotatable with the support and a second portion having ports for receiving the powder, fuel and oxygen and communicating same to the corresponding supply lines;

a motor for rotating the support; and a mechanism for moving the support and the thermal spray gun parallel to the axis independently of the surface of the workpiece to be coated.

10. The apparatus according to claim 9, wherein the thermal spray gun is a high velocity oxy-fuel spray gun.

11. The apparatus according to claim 9, wherein the gun is a powder combustion gun.

12. The apparatus according to claim 9, wherein the support and the downwardly depending member comprise hollow tubular members constituting the supply line for the powder.

13. The apparatus according to claim 9, wherein the support further comprises a counterbalance opposite the gun with the axis therebetween to dynamically balance the gun during rotation.

14. The apparatus according to claim 9, wherein the at least one coupling comprises two couplings including a first coupling for the powder and a second coupling for the fuel and oxygen.

15. The apparatus according to claim 14, wherein the second coupling has ports receptive of cooling air and has an inlet and an outlet for water and further comprising supply lines for the air and water.

16. The apparatus according to claim 9, wherein the support permits a radial distance between the thermal spray gun and the workpiece to be adjusted.

* * * * *